US006935966B2

(12) United States Patent
Kershaw

(10) Patent No.: US 6,935,966 B2
(45) Date of Patent: Aug. 30, 2005

(54) BASKETBALL HOOP RIM COVER

(76) Inventor: Thomas R. Kershaw, 5626 Riverside Dr., Cape Coral, FL (US) 33904

( * ) Notice: Subject to any disclaimer, the term of this patent is extended or adjusted under 35 U.S.C. 154(b) by 186 days.

(21) Appl. No.: 10/353,246

(22) Filed: Jan. 30, 2003

(65) Prior Publication Data

US 2004/0152543 A1 Aug. 5, 2004

(51) Int. Cl.[7] ..... A63B 69/00
(52) U.S. Cl. ..... 473/248
(58) Field of Search ..... 473/485, 448, 473/415, 449, 447, FOR 100, FOR 101; 74/550; D21/780

(56) References Cited

U.S. PATENT DOCUMENTS 1,490,142 A * 4/1924 Stone et al. ..... 74/558
5,327,799 A * 7/1994 Lin ..... 74/558
D447,455 S * 9/2001 Stevens ..... D12/177
2001/0010179 A1 * 8/2001 Ku ..... 74/558

* cited by examiner

*Primary Examiner*—Gregory Vidovich
*Assistant Examiner*—M. Chambers

(57) ABSTRACT

A basketball hoop cover that is somewhat tubular and circular in shape with a slit along its length to allow a fitting over an existing basketball rim to provide a player protection and increased hoop visibility. The device also provides a way of reducing the ball entry area and includes particular targeting features that may assist in improving the skill level and enjoyment for the basketball shooter. The single piece tubular cover is contoured similar to an existing rim diameter and installs, without any tools or additional fasteners to a variety of existing rims and permits an easy way of custom fitting and trimming to satisfy unforeseen or unusual applications.

5 Claims, 4 Drawing Sheets

BASKETBALL HOOP RIM COVER

BACKGROUND OF THE INVENTION

The present invention relates to basketball hoop covers, and more particularly, to a flexible decorated, colored or marked cover so as to provide better visibility, finger protection, rim size reduction and targeting features to assist the shooter.

Traditionally, basketball hoops have only a net affixed to them and have no distinguishing features which may be used as targets in practice for a player to shoot at.

DESCRIPTION OF THE PRIOR ART

U.S. Pat. No. 4,082,269 discloses a protective basketball hoop that is made of a plastic material which will surround the hoop in a hugging manner. The net of the basket ball hoop arrangement is partially embedded in the plastic material which then will hold the net in place. This is not what the invention at hand is trying to accomplish.

U.S. Pat. No. 4,903,964 illustrates a basketball net attaching device for generally tubular netting with upper shaped net strings or cords. This device is far removed from the inventive concept that applicant is disclosing and claiming.

U.S. Pat. No. 5,195,742 shows a basket ball hoop guard including a fluid impervious cover that is attached to the hoop on top to guard against injury to the fingers of a player. The guard includes a foam rubber ring which is attached to the hoop and in addition to the guard has a cover attached to the top of the guard. This is not the applicant's design which includes a visual interpretation of the hoop.

SUMMARY AND OBJECTS OF THE INVENTION

The cover for the basketball hoop can best be described as a vibrant colored circular contoured soft rubber cover (similar to a hose) including a continuous slit in the underside of the cover and providing markings and openings around the outside perimeter including nubs protruding inwardly. The cover slips over and pinches itself to an existing basketball rim or hoop to provide four identified features:

1) rim visibility;
2) player protection;
3) rim size reduction;
4) target alignment.

DETAILED DESCRIPTION OF THE INVENTION

Figure 1:
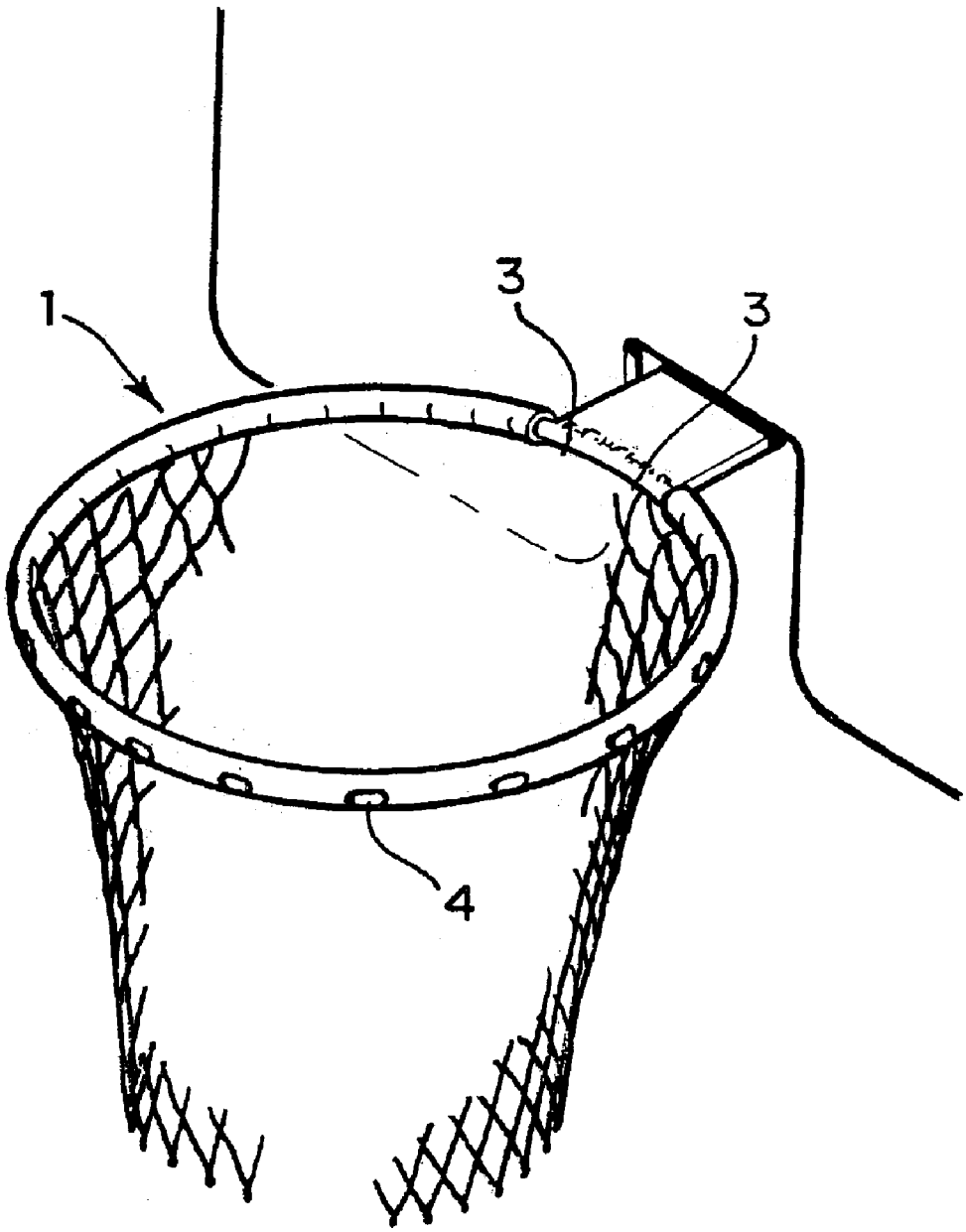
FIG. 1 is a perspective view of the circular and tubular rim cover installed on a basketball hoop rim.

FIG. 1 illustrates a perspective view of the cover 1 as it is installed on a hoop rim. The cover 1 consists of a tubular construction of plastic material of soft rubber that can be draped over an existing basket ball rim. For this purpose, the tubular construction is shaped similar to a hollow circular tube of circular cross section having a slit 2 (FIG. 3) throughout its length and on the bottom side so that it can be draped over an existing hoop rim whereby it will hold itself in the installed position. The circular tube is interrupted as shown at 3 so that it can accommodate a holding bracket 7 as shown FIG. 3. FIG. 1 further shows openings and/or markings for target alignment features for the player.

Figure 2:
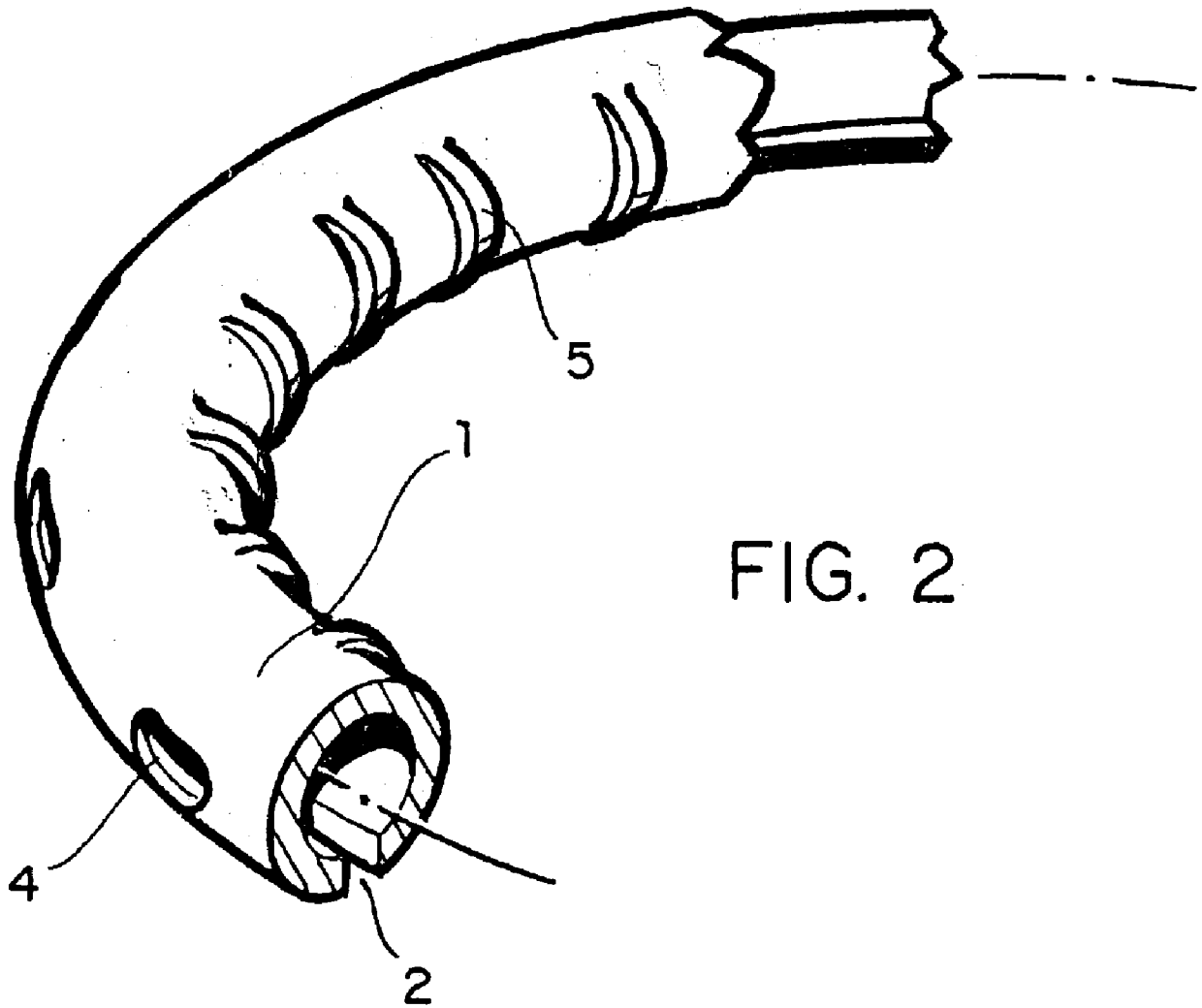
FIG. 2 is a perspective view of the rim cover.

FIG. 2 shows the tubular cover in a cross section, whereby the bottom circumferential slit 2 is identified including the player alignment markings or openings 4. Also shown in this Fig. are nubs 5 placed thereon or similar shapes of material extending inwardly to reduce the diameter of the ball entry area to enhance skill levels so that the inwardly protruding nubs in the shape of ribs or nubs in the shape of triangular protrusions 8 will be an aid for the player to deliver more accurate shots.

Figure 3:
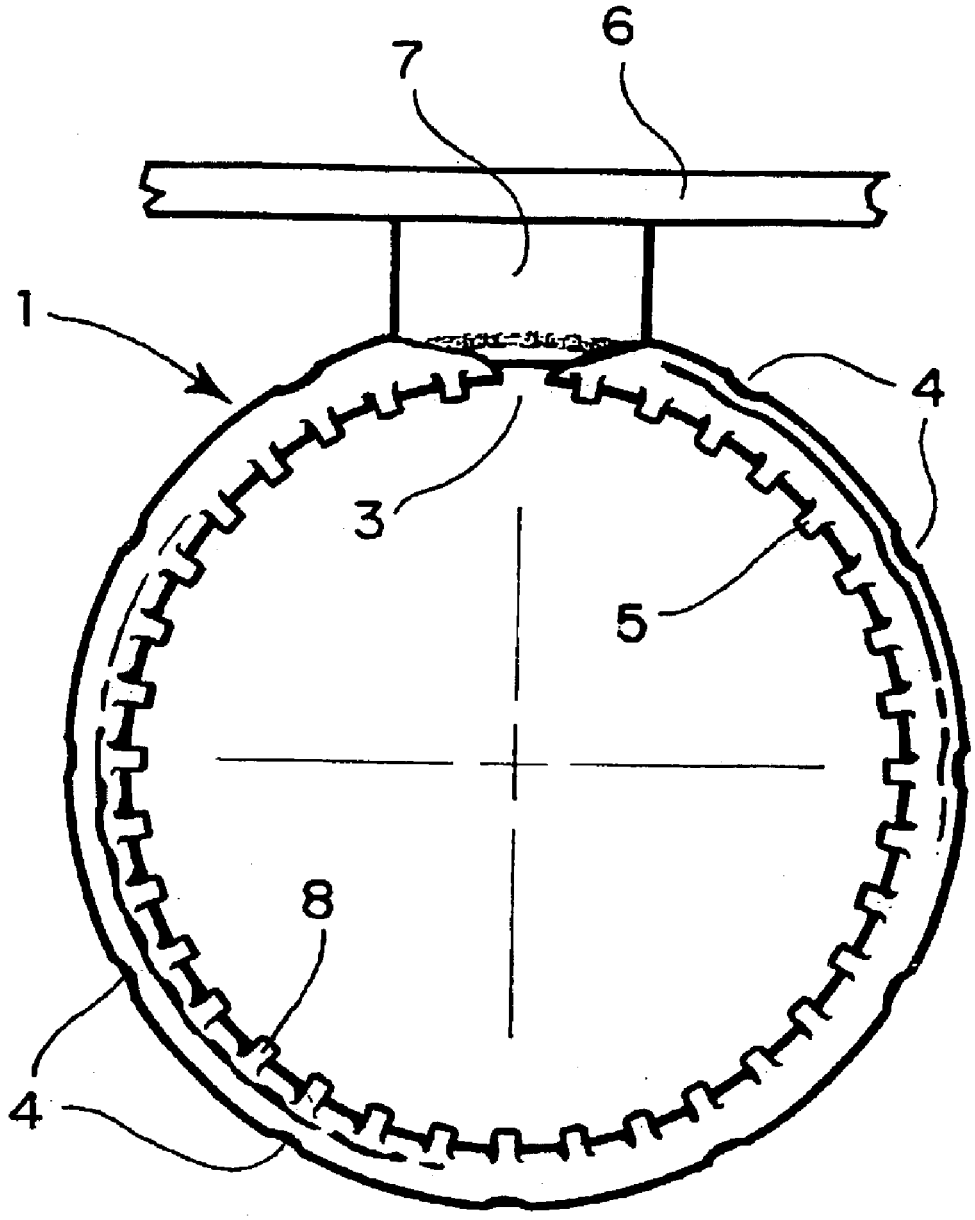
FIG. 3 is a top view of the rim cover installed on a basket ball rim.
Figure 4:
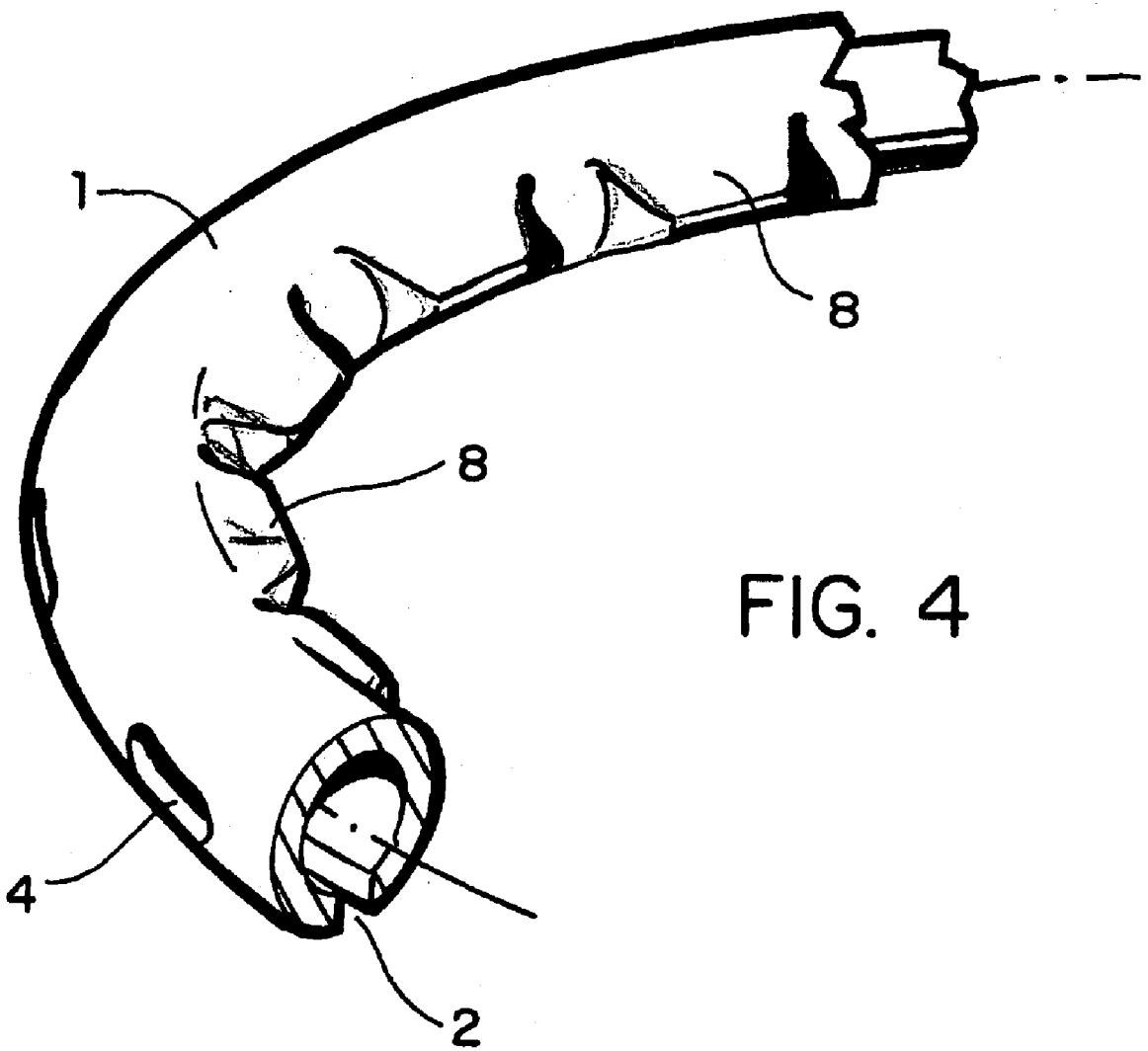
FIG. 4 is a perspective view of a section of a rim cover showing triangular nubs on an interior circumference of the rim.

FIG. 3 is a top view of the basketball rim with the tubular cover 1 installed thereon. The basketball rim is installed on the well known back board 6 by way of a bracket 7. It can now be seen that the interruption 3 in the tubular cover 1 is designed to accommodate the bracket 7 when it is slipped over the hoop rim and can be trimmed to accept various bracket configurations, FIG. 4 is a perspective view, especially of the inside of the rim, wherein the nubs 8 are reproduced in a triangular form protruding toward the inside of the inside perimeter to thereby reduce the official playing diameter for accuracy reasons. Special attention should be directed to the color of the tubular hoop rim cover. Since the cover is only used during practice sessions of the game, it is important to use a color that is readily identifiable to any player, such as, bright yellow and other colors that can readily be seen in semi-darkness, such as, reflective paint colors and phosphorous paints.

What I claim is:

1. In combination with a basketball rim, a cover having the shape of a circular and tubular hose-like sheath and having a continuous slit at its underside to be slipped over an existing hoop rim, said underside being parallel with and below said rim, said cover having markings provided at locations at an outer circumference and further said cover having a plurality of inwardly protruding nubs extending inwardly toward the center of said cover diameter and said nubs reducing the overall interior ball entry of said rim, said nubs being integrally formed with said cover and said plurality of nubs being greater than two and said cover further having an interruption in its circumference to accommodate a bracket that mounts said basketball rim to a backboard.

2. The basket hoop rim cover of claim 1 including highly visible colors for said cover.

3. The basketball hoop rim cover of claim 1, wherein said nubs have the shape of ribs.

4. The basketball hoop rim cover of claim 1, wherein said nubs have the shape of a triangle.

5. The basketball hoop rim cover of claim 1, wherein said markings are openings in said cover.

* * * * *